US012247479B2

(12) United States Patent
Borisov et al.

(10) Patent No.: US 12,247,479 B2
(45) Date of Patent: Mar. 11, 2025

(54) WELLBORE MAGNETIC TOOL APPARATUS FOR USE IN MEASUREMENT WHILE DRILLING

(71) Applicant: PROFORMA ENGINEERING LTD., Winnipeg (CA)

(72) Inventors: Genadi Borisov, Winnipeg (CA); Heather Jean Grace Pankratz, Winnipeg (CA); Douglas Cory Krokosz, Winnipeg (CA)

(73) Assignee: Proforma Engineering Ltd., Winnipeg (CA)

( * ) Notice: Subject to any disclaimer, the term of this patent is extended or adjusted under 35 U.S.C. 154(b) by 0 days.

(21) Appl. No.: 18/258,928

(22) PCT Filed: Nov. 25, 2021

(86) PCT No.: PCT/CA2021/051685
§ 371 (c)(1),
(2) Date: Jun. 22, 2023

(87) PCT Pub. No.: WO2022/133580
PCT Pub. Date: Jun. 30, 2022

(65) Prior Publication Data

US 2024/0044245 A1 Feb. 8, 2024

Related U.S. Application Data

(60) Provisional application No. 63/128,976, filed on Dec. 22, 2020.

(51) Int. Cl.
*E21B 47/01* (2012.01)

(52) U.S. Cl.
CPC ..... *E21B 47/01* (2013.01)

(58) Field of Classification Search
CPC ..... E21B 47/01
See application file for complete search history.

(56) References Cited

U.S. PATENT DOCUMENTS 3,513,912 A * 5/1970 Boop ..... E21B 47/092 166/66.5
5,325,055 A * 6/1994 Geringer ..... G01P 3/487 324/207.22
6,522,137 B1 * 2/2003 Sun ..... G01N 24/081 324/303

(Continued)

*Primary Examiner* — Taras P Bemko
(74) *Attorney, Agent, or Firm* — Ryan W. Dupuis; Michael R. Williams; Ade & Company Inc.

(57) ABSTRACT

A wellbore magnetic tool apparatus is used for generating a magnetic field emanating from a tubing string. The apparatus has a tubular body for connection in series with the tubing string. Magnetic elements are mounted within one or more cavities in the tubular body such that the field directions of all magnetic elements are aligned in a common direction extending along a diametrical axis of the tubular body. The cavities are open to an interior of the body so that the magnetic elements are inserted into the cavities through an inner longitudinal passage of the tubular body. One or more covers close the cavities relative to the longitudinal passage in the tubular body. Magnet receiving cavities open to the interior enable a proportionally larger cavity with greater density of magnets without weakening of the structure of the body.

17 Claims, 6 Drawing Sheets

(56) References Cited

U.S. PATENT DOCUMENTS

| | | | | |
|---|---|---|---|---|
| 10,191,178 | B2 * | 1/2019 | Xiao | G01V 3/32 |
| 10,294,733 | B2 * | 5/2019 | Johnson | E21B 17/076 |
| 11,125,073 | B2 * | 9/2021 | Ahmad | E21B 47/092 |
| 2008/0230277 | A1 * | 9/2008 | Hall | E21B 47/01<br>175/325.1 |
| 2010/0206736 | A1 * | 8/2010 | Ishida | G01N 33/2028<br>205/81 |
| 2012/0013339 | A1 * | 1/2012 | Kuckes | E21B 47/0228<br>324/346 |
| 2016/0177705 | A1 * | 6/2016 | Derr | E21B 47/0228<br>175/45 |

* cited by examiner

WELLBORE MAGNETIC TOOL APPARATUS FOR USE IN MEASUREMENT WHILE DRILLING

FIELD OF THE INVENTION

The present invention relates to a magnetic tool apparatus which can be connected to a tubing string for insertion into a wellbore, for example a drill string, for generating a magnetic field emanating from the tubing string during a downhole operation.

BACKGROUND

In oil and gas exploration or in deep geothermal well drilling, a drilling method known as Measurement While Drilling may include use of a drilling tool with sensors to read location of a target from which a magnetic field is emanating, or conversely a sensor is located in the target area to read the location of a magnetic field emanating from the drilling equipment as shown in FIG. 1. One prior art arrangement for generating a magnetic field from the drilling equipment according to FIG. 1 includes the use of a magnetic sub as shown in FIGS. 2 and 3 that can be connected in series with the drilling string between a drilling motor and a drilling bit. The magnetic sub includes a tubular body with ports drilled into the outer side of the tubular body to receive magnets therein which are subsequently held in place using epoxy, metal snap rings, metal caps, or any combination thereof such that the epoxy and/or metal parts are exposed to the drilling environment. These components thus frequently require maintenance as the epoxy erodes during use. Furthermore, the density of the magnets is limited due to the weakening of the integrity of the tubular body from the drilling of the ports into the tubular body.

SUMMARY OF THE INVENTION

According to one aspect of the invention there is provided a wellbore tool apparatus for generating a magnetic field emanating from a tubing string having a tubing passage extending longitudinally through the tubing string, the wellbore tool apparatus comprising:

- a tubular body including a longitudinal passage extending axially through the tubular body between opposing ends of the tubular body;
- tubing connectors mounted on the opposing ends of the tubular body respectively so as to be arranged to connect the tubular body in series with the tubing string such that the longitudinal passage of the tubular body communicates with the tubing passage of the tubing string;
- a plurality of magnetic elements, each magnetic element having a magnetic field extending in a field direction from a first pole at a first end to a second pole at a second end of the magnetic element;
- one or more cavities formed in the tubular body to as to be arranged to receive the magnetic elements therein such that the field direction of all magnetic elements are substantially aligned in a common direction extending along a diametrical axis of the tubular body;
- said one or more cavities being open inwardly towards the longitudinal passage within the tubular body so as to be arranged to receive the magnetic elements inserted therein through the longitudinal passage in the tubular body; and

- one or more covers arranged to close said one or more cavities relative to the longitudinal passage in the tubular body with the plurality of magnetic elements enclosed within said one or more cavities.

By providing a cavity for the magnets which is open to the interior of the tubular body, a much larger cavity with a greater density of magnets can be provided than prior art arrangements, without weakening of the structure of the tubular body. Conversely, the tool can be shorter than prior art arrangements while providing the same strength of magnetic field.

The tool also has increased durability because material covering the magnets within the cavity is not exposed to the drilling environment. The cavity being open to the interior of the tubular body is also well suited to being enclosed by use of an inner liner tube forming the cover. This inner liner tube may be a sacrificial member which can be readily replaced with each new use of the tool, while being much more resistant to corrosive environments than the epoxy material of the prior art while in use.

The one or more covers preferably form part of a boundary wall surrounding the longitudinal passage extending through the tubular body.

The one or more covers may comprise an inner sleeve defining a portion of a length of the longitudinal passage through the tubular body. In this instance, the one or more cavities may be annular in shape about the inner sleeve. Preferably the inner sleeve is arranged to be inserted and removed axially through a first end among the opposing ends of the tubular body. An inner diameter of the inner sleeve may be substantially identical to an inner diameter of a portion of the longitudinal passage that is defined by the tubular body.

Preferably the at least one cover is mounted within the tubular body in an interference fit relationship.

The at least one cover is preferably formed of non-ferromagnetic material.

A material forming said at least one cover may be identical to a material forming the tubular body.

Some of the magnetic elements may be abutted with one another in a circumferential direction of the tubular body.

Some of the magnetic elements may be abutted with one another in an axial direction of the tubular body.

The one or more cavities may comprise a single annular shaped cavity receiving all of the magnetic elements therein.

Each magnetic element may be wedge shaped so as to increase in dimension in a circumferential direction with increasing radial distance from the longitudinal passage. In this instance, the magnetic elements may include first magnetic elements supported at a first side of the tubular body and second magnetic elements supported at a second side of the tubular body opposite to the first side along said diametrical axis, in which the first magnetic elements increase in width in the field direction from the first pole to the second pole, and the second magnetic elements decrease in width in the field direction from the first pole to the second pole.

When said one or more cavities are annular in shape about the longitudinal passage, the magnetic elements may include first magnetic elements supported at a first side of the tubular body and second magnetic elements supported at a second side of tubular body opposite to the first side along said diametrical axis, while one or more spacers may be supported in said one or more cavities between the first magnetic elements and the second magnetic elements. The magnetic elements and the one or more spacers may collectively fully occupy said one or more cavities.

The tubular body is preferably formed of non-ferromagnetic material.

When used in combination with the tubing string, the tubing string may comprise a drill string including a drill motor and a drill bit supported at a bottom end of the drill string, in which the tubular body of the wellbore magnetic tool apparatus is mounted in series between the drill motor and the drill bit of the drill string.

The invention according to the illustrated embodiment uses custom arc shaped magnets similar to a section of a torus installed between the outer and inner housing of the tubular body. This arrangement allows more magnets to be installed than typical and thus maximizes the volume available for the magnets. In a cross section of the tubular body, one side of the tube is maximized as a positive pole and the opposite side is maximized as a negative pole. The maximum density of rare earth permanent magnets installed in the body will allow the maximum amount of magnetic field to be created.

All of the parts of the apparatus other than the magnets are non-ferromagnetic and are manufactured from INCONEL 718 high strength non-magnetic material according to the preferred embodiment such that the magnetic field is free to expand outward radially from the equipment.

The magnetic tool apparatus according to the present invention is improved over prior art magnetic subs that support magnets in external ports sealed with epoxy as follows:

(i) The amount of volume of magnet is increased to as much as double by using a custom shaped magnet optimized for the space provided between inner and outer tubular boundary walls. This allows either a longer distance to be measured with a similar sized tool, or use of a smaller and/or shorter tool for the same level of magnetism and measurement range. Either one of these benefits improve the equipment functionality.

(ii) The strength of the tool is increased because no ports or bores are required to be drilled radially into the body of the tool and filled with epoxy material.

(iii) The durability of the tool is greater because no epoxy is relied upon to be exposed to the drilling environment.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
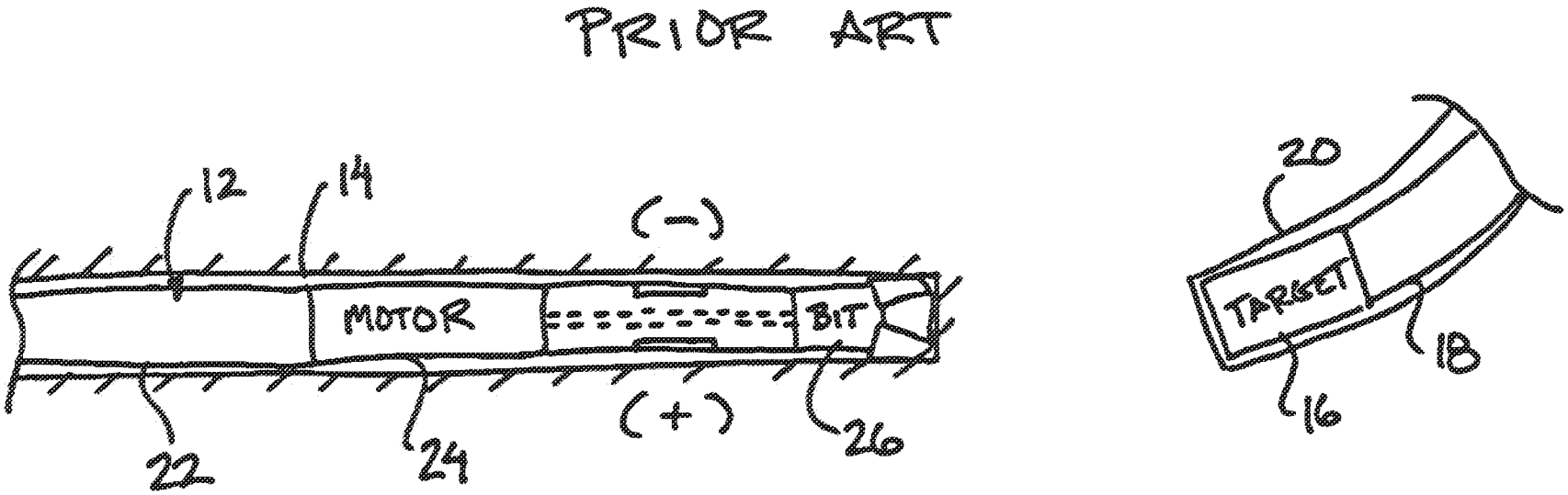
FIG. 1 is a schematic representation of a prior art wellbore drilling arrangement in which a magnetic sub is used to guide a drilling string towards a target device.

Referring to the accompanying figures there is illustrated a wellbore magnetic tool apparatus generally indicated by reference numeral 10. The apparatus 10 is particularly suited for mounting in series with a first tubing string 12 within first wellbore 14 for generating a magnetic field that can be read from a target sensor 16 on a second tubing string 18 within a second wellbore 20 in a Measurement While Drilling wellbore operation according to FIG. 1.

In a preferred arrangement, the apparatus 10 is well suited for connection within the first tubing string when the first tubing string is a drill string for drilling the respective wellbore in which the drill string is comprised of sections of tubing 22 that are connected longitudinally in series with one another to define a tubing passage communicating longitudinally through the drill string. A drilling motor 24 is mounted towards the bottom of the drill string and is connected to a drill bit 26 therebelow at the bottom end of the drill string 12.

The apparatus 10 generally includes a tubular body 30 supporting an inner sleeve 32 therein so as to define an internal cavity 34 within the tubular body 30 that is enclosed between the inner sleeve 32 at an inner boundary of the cavity and a surrounding outer wall 36 of the tubular body at an outer boundary of the cavity. A plurality of magnetic elements 38 and spacer elements 40 are enclosed within the cavity 34 to substantially fully occupy the interior volume of the cavity as described in further detail below.

The tubular body 30 is elongate in an axial direction between a first end 42 and an opposing second end 44 of the body. A longitudinal passage 46 extends axially through the tubular body between the opposing ends thereof. The outer wall 36 of the tubular body is cylindrical in shape having a constant outer diameter which is continuous and uninterrupted between the opposing ends of the body.

A first tubing connector 48 is provided at the first end 42 of the tubular body and a second tubing connector 50 is provided at the second end 44 of the tubular body. The tubing connectors 48 and 50 serve to connect the tubular body in series with the drill string 12 such that the longitudinal passage 46 extending through the tubular body of the apparatus 10 communicates with the tubing passage extending longitudinally through the tubing string.

At the first end of the tubular body in the illustrated embodiment, the first tubing connector 48 is a female connector formed of an internal bore which is internally threaded and which tapers in internal diameter axially inward from the outer end of the tubular body. At the inner end of the first tubing connector 48, a first end portion 52 is defined within the tubular body in which the internal diameter is constant and defines a minimum diameter towards the first end 42 of the tubular body.

At the second end of the tubular body in the illustrated embodiment, the second tubing connector 50 is a male connector defined by a collar portion in which the body is reduced in outer diameter relative to the outer wall 36 that spans the main portion of the tubular body. The collar portion defining the second tubing connector 50 protrudes axially beyond the second end of the outer wall 36 of the tubular body. The male connector 50 is externally threaded with an outer diameter that tapers axially outward so as to be suitable for forming a mating connection with the female connector of an adjacent tubing section.

In further embodiments, the tubing connectors at the opposing first and second ends may take various forms of tubing connectors which may be conventionally known for mating with existing tubing sections of various commercially available tubing strings.

Within the interior of the male tubing connector 50 at the second end of the tubular body according to the illustrated embodiment, a second end portion 54 is defined having a constant internal diameter which is reduced slightly relative to the inner diameter at the first end portion 52 by a radial distance corresponding approximately to the radial thickness of the inner sleeve 32. The second end portion 54 defines part of the outer boundary of the longitudinal passage 46 extending through the apparatus 10.

A counterbore 56 extends axially inward from the second end portion 54 in which the internal diameter within the tubular body at the counterbore is stepped inwardly and increased relative to the inner diameter of the second end portion to define an internal shoulder 58 perpendicular to the longitudinal axis of the tubular body at an intersection between the second end portion 54 and the counterbore 56. The inner diameter within the tubular body at the counterbore 56 is equal to the inner diameter at the first end portion 52, which is in turn approximately equal or slightly less than the outer diameter of the inner sleeve 32.

The inner sleeve 32 has a length in the axial direction which spans a main portion of the tubular body 30 to partially overlap the first end portion 52 in proximity to the first and of the tubular body when the opposing second end of the sleeve abuts the internal shoulder 58 so that the second end of the sleeve fully overlaps the second end portion 54 within the interior of the tubular body. As the first end portion 52 defines a minimum inner diameter at the first end of the tubular body with the interior dimensions of the first tubing connector extending axially outward therefrom increasing in diameter relative to the first end portion 52, the inner sleeve 32 can be readily inserted into the interior of the tubular body through the first end of the tubular body. Due to the interference fit between the outer diameter of the inner sleeve 32 and the inner diameter of the first end portion 52 and counterbore 56 receiving the sleeve therein, the inner sleeve is retained in a mounted position within the tubular body by a press fit relationship between the sleeve and the tubular body 30 at both ends of the sleeve.

The interior diameter of the sleeve is approximately equal to the interior diameter defined by the second end portion 54 at the second end of the tubular body. The inner surface of the inner sleeve thus defines the majority of the boundary surrounding the longitudinal passage extending through the apparatus 10.

The wall thickness of the inner sleeve is small compared to the wall thickness of the outer wall 36 of the tubular body; however, the inner sleeve is intended to be replaceable when it becomes worn or corroded from fluid passage through the longitudinal passage or from passage of tools through the longitudinal passage of the tubing string.

The tubular body 30 defines the cavity 34 therein between (i) the first end portion 52 of the tubular body that is overlapped by a first end of the inner sleeve 32 and (ii) the counterbore 56 that is overlapped by a second end of the inner sleeve so that the inner sleeve spans the full length of the cavity 34. The main cavity is annular in shape about the inner sleeve by forming the tubular body to be increased in internal diameter along the main portion of the body between the first end portion 52 at the first end and the counterbore 56 at the second end of the body. In the absence of the inner sleeve 32, the cavity 34 is open to the longitudinal passage communicating axially through the tubular body. Once the inner sleeve is mounted within the tubular body, the cavity has a consistent radial dimension about the circumference thereof and axially along the length thereof between an inner boundary formed by the inner sleeve 32 and an outer boundary formed by the outer wall 36 of the tubular body.

The magnetic elements 38 are formed in two sets including a plurality of first magnetic elements 60 mounted at a first side 62 of the tubular body and a plurality of second magnets 64 mounted at a second side 66 of the tubular body which is diametrically opposite from the first side 62. More particularly the first and second sides of the tubular body locating the first and second magnetic elements therein respectively are opposed from one another along a prescribed diametrical axis of the tubular body.

Each magnetic element is a permanent magnet having a prescribed electric field oriented in a field direction F extending from a first pole 68 to a second pole 70 of the magnet. All of the magnetic elements are mounted within the cavity 34 so that the field directions F of the magnets are aligned with one another in a common direction parallel to the prescribed diametrical axis.

The magnetic elements comprise blocks which are stacked axially and abutted circumferentially with adjacent ones of the magnetic elements within the annular cavity at the opposing first and second sides of the tubular body. At the first side 62, two columns of the first magnetic elements 60 are provided in which the blocks are stacked in the axial direction within each column and in which the two columns are circumferentially adjacent one another. Accordingly, each of the magnetic elements in one column is circumferentially abutted against a corresponding magnetic element in the adjacent column.

Likewise, at the second side 66, two columns of the second magnetic elements 64 are similarly stacked in the axial direction within each column, in which the two columns are circumferentially adjacent one another such that each of the magnetic elements of one column is circumferentially abutted against a corresponding magnetic element in the adjacent column.

Each individual magnetic element is a wedge-shaped block occupying approximately a 30 degree arc within the annular shape of the cavity 34. In this manner, each individual magnetic element has a convex outer edge lying against the similarly curved inner surface of the outer wall 36 of the tubular body and a concave inner edge lying against the similarly curved inner sleeve 32. The lateral boundaries of each magnetic element comprise flat surfaces oriented along respective radial axes of the tubular body. Opposing end faces of each magnetic element lie perpendicular to the axial direction of the tubular body for abutment against adjacent magnetic elements within the respective axially stacked columns.

All of the first magnetic elements 60 are similarly configured such that the width in the circumferential direction diverges outwardly as the magnetic element extends radially outward from the first pole 68 to the second pole 70, resulting in the first magnetic elements being wider at the second pole 70 than the first pole 68.

The second magnetic elements 64 have a polarity relative to the shape of the block that is opposite to that of the first magnetic element 16. The second magnetic elements 64 similarly have a width in the circumferential direction that diverges outwardly as the magnetic element extends radially outward, however, the second magnetic elements extend radially outward relative to the tubular body from the second pole 70 to the first pole 68 opposite to the field orientation F, resulting in the second magnetic elements being wider at the first pole 68 than the second pole 70. However, as noted above, this results in all of the first and second magnetic elements being oriented with their field direction aligned in a common field direction F from the second side 66 to the first side 62 of the tubular body.

The spacer elements 40 occupy the remainder of the cavity 34 not occupied by magnetic elements. As each magnetic element spans an arc of approximately 30 degrees, the two columns of magnetic elements at each of the opposing first and second sides of the tubular body result in magnetic elements spanning arcs of 60 degrees at each of the opposing sides of the tubular body. This results in two diametrically opposed circumferential gaps in the cavity in the order of approximately 120 degrees spanning between the grouping of first magnetic elements 60 and the grouping of second magnetic elements 64.

In the illustrated embodiment, the spacer elements similarly occupy an arc of approximately 30 degrees within the annular cavity so that a set of four circumferentially abutted spacer elements occupy each of the two gaps within the cavity 34. In this manner, each spacer element has a similar profile extending in the axial direction as the profile of the magnetic elements, having a concave inner boundary abutted against the inner sleeve 32 and a convex outer boundary abutted against the corresponding curvature at the inner surface of the outer wall 36 of the tubular body.

The spacer elements 40 differ from the magnetic elements in that each spacer element column may comprise a single spacer element spanning the full-length of the cavity 34 in the axial direction such that each spacer element spans the full height of an entire column of stacked magnetic elements.

The spacer elements may be formed of any durable and rigid non-ferromagnetic material which provides sufficient structural support to maintain the position of the magnetic elements within the cavity relative to one another and relative to the tubular body. The spacer elements may optionally be formed of the same material as the tubular body 30 and the inner sleeve 32.

The tubular body 30 and the inner sleeve 32 are formed of an identical non-ferromagnetic material.

The apparatus 10 is assembled by initially inserting some of the spacer elements and all of the magnetic elements individually through the longitudinal passage at the first end of the tubular body. The minimum diameter at the first end portion 52 at the first end of the tubular body defines a circle that circumscribes or is larger in diameter than a prescribed circle that would circumscribe the continuous profile of each of the spacer elements and the magnetic elements to ensure that the elements can be inserted through the first end of the tubular body into the interior of the cavity 34.

To assist in insertion of the last spacer element, the last spacer element may be segmented by an additional segmentation 72 which extends fully through the spacer from the inner boundary to the outer boundary thereof along a plane lying parallel to one of the lateral boundaries of the spacer element. In this manner a final section 74 of the spacer element can be inserted into the cavity due to the laterally opposing boundaries of the final spacer segment being parallel to one another. Once the last segment 74 of the last spacer element is inserted into the cavity, the cavity is fully occupied by magnetic elements and spacer elements.

Finally, the inner sleeve 32 can be inserted through the first end of the tubular body into press-fit relationship with the first end portion 52 in proximity to the first end 42 of the tubular body and into press-fit relationship with the counterbore 56 in proximity to the second end 44 of the tubular body.

The inner sleeve acts as a cover enclosing the inner boundary of the cavity 34 which would otherwise be open to the longitudinal passage through the interior of the tubular body. The press-fit relationship between the inner sleeve and the tubular body at axially opposing ends of the inner sleeve provides a secure fluid tight seal between the inner sleeve and the surrounding tubular body at axially opposing ends thereof to ensure that any fluids communicated through the longitudinal passage of the tubular body cannot penetrate into the cavity 30 for locating the magnetic elements therein.

Once assembled, the tubular body of the apparatus 10 can be connected in series with the drill string 12 between the drill motor 24 and the drill bit 26 as described above. The resulting magnetic field emanating from the magnetic elements within the apparatus 10 can be detected by sensors of the targeted second string 18 in the usual manner.

Figure 10:
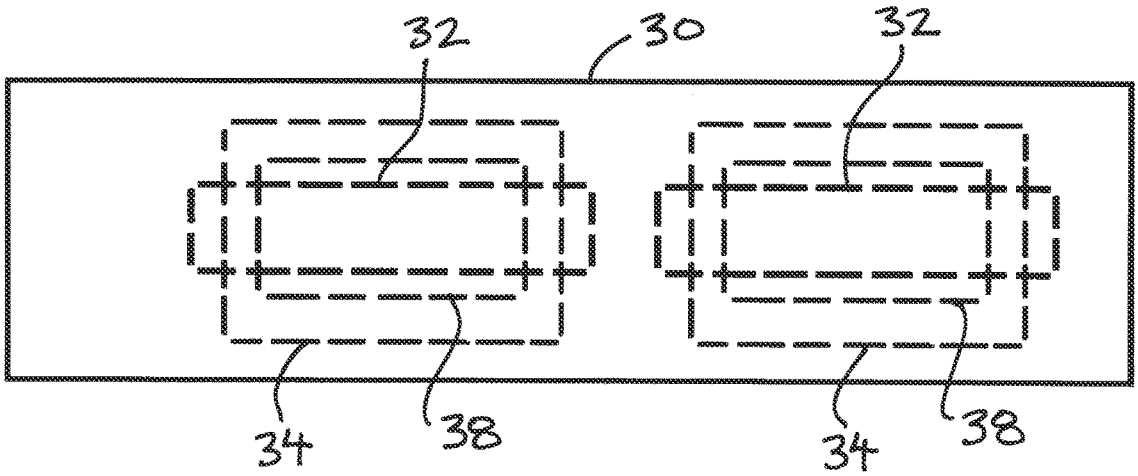
FIG. 10 is a schematic representation of a further embodiment of the wellbore magnetic tool apparatus including more than one cavity receiving magnetic elements therein.

In further embodiments, as represented schematically in FIG. 10, the cavity formed in the tubular body 30 for receiving the magnetic elements therein may comprise a plurality of separate cavities 34 receiving one or more magnetic elements 38 therein while the cavities remain open to the longitudinal passage through the tubular body until closed by a suitable one or more covers 32. A single inner sleeve may function as the one or more covers 32 for a plurality of the cavities.

In yet further arrangements, if a plurality of separated cavities are provided, separate covers may be provided within the interior of the tubular body such as a plurality of sleeves spanning respective axial sections of the tubular body.

In yet further embodiments, other materials may be used to form a cover enclosing the cavities that are otherwise open to the interior of the tubular body.

The shape of the cavities and the corresponding shape of the magnets may further vary in other embodiments.

Use of one or more cavities which are open to the interior of the tubular body prior to being enclosed by a suitable cover has the advantages of the cover being in a less corrosive environment than the exterior of the tubular body, while the outer wall 36 of the tubular body remains uninterrupted to maintain optimum strength of the tubular body.

Figure 2:
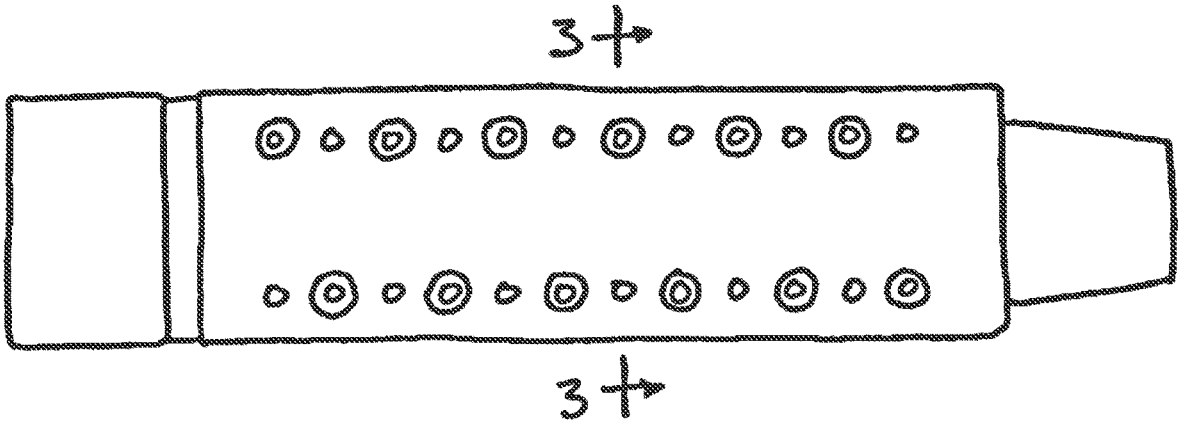
FIG. 2 PRIOR ART
FIG. 2 is a side view of a prior art example of the magnetic sub.
Figure 3:
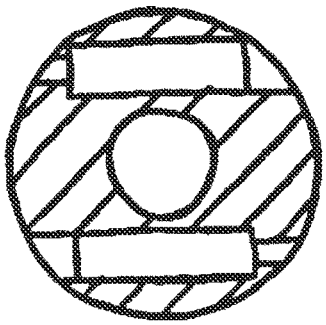
FIG. 3 is a sectional view of the prior art magnetic according to FIG. 2.
Figure 4:
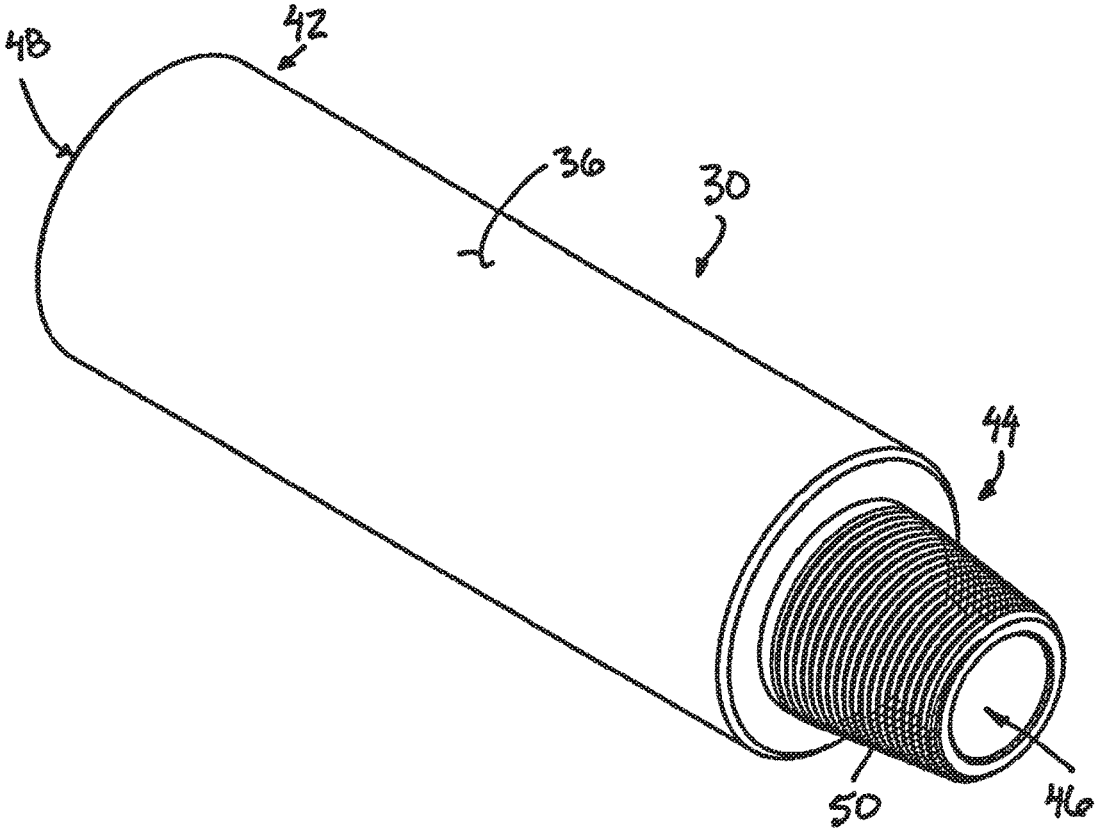
FIG. 4 is a perspective view the wellbore magnetic tool apparatus according to the present invention for use in the drilling arrangement of FIG. 1 in place of the prior art magnetic sub.
Figure 5:
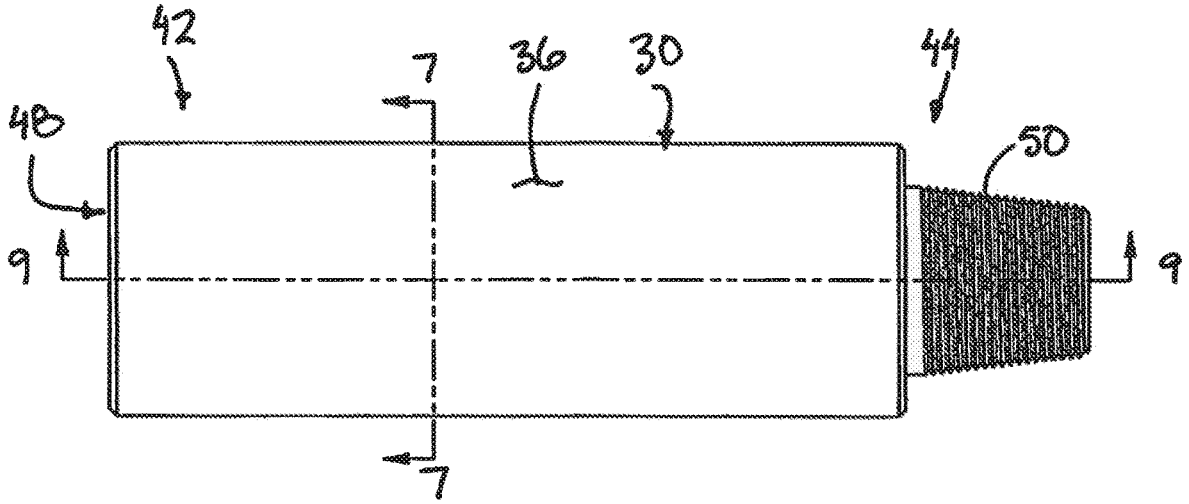
FIG. 5 is side view of the wellbore magnetic tool apparatus according to FIG. 4.
Figure 6:
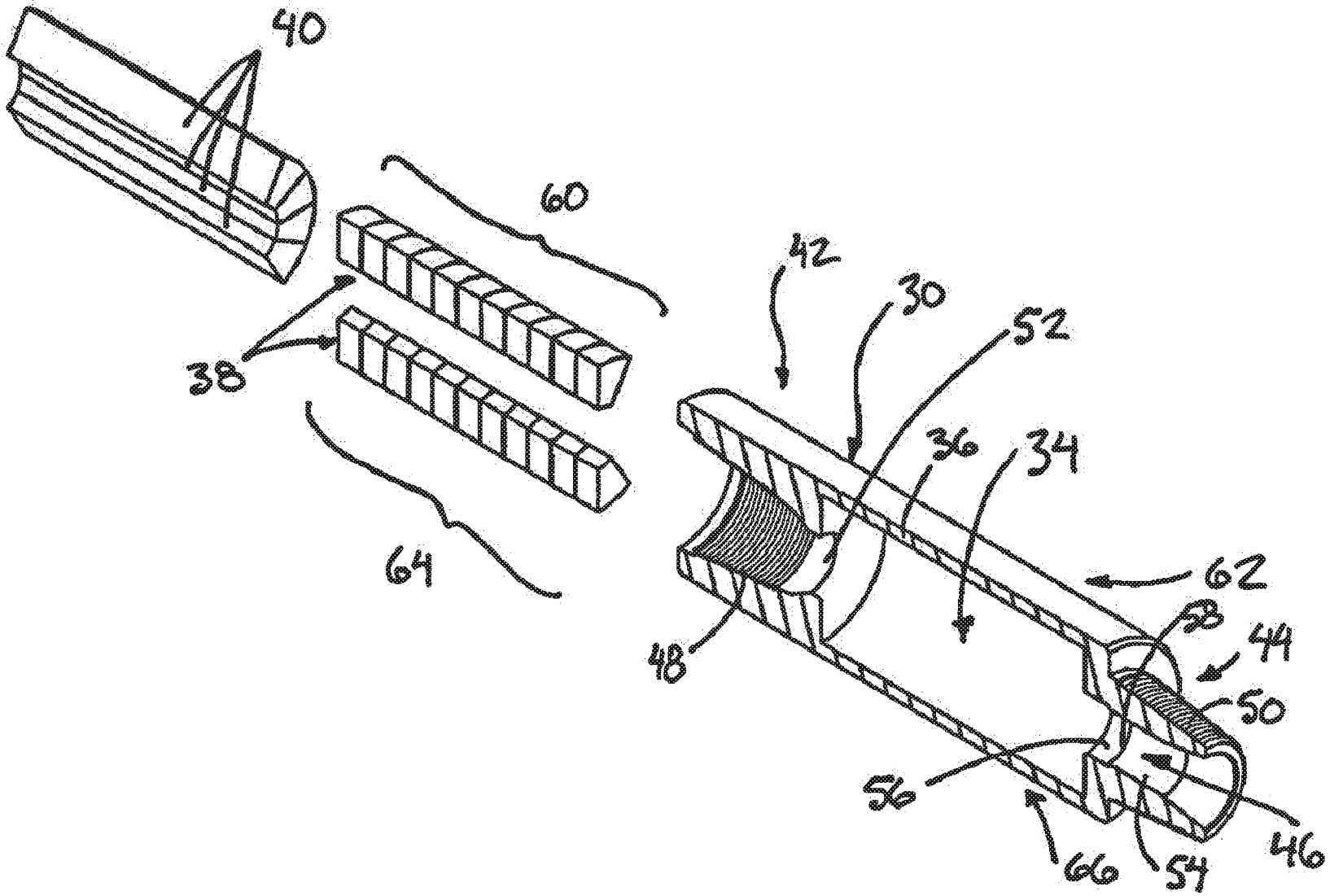
FIG. 6 is a partly sectional, exploded, perspective view of the wellbore magnetic tool apparatus according to FIG. 4.
Figure 7:
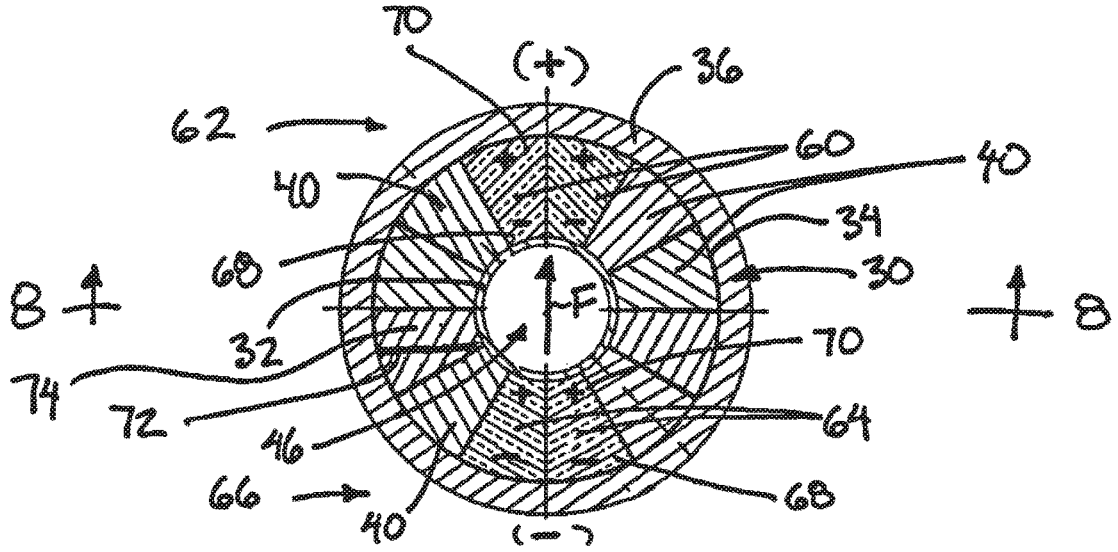
FIG. 7 is a sectional view of the wellbore magnetic tool apparatus along the line 7-7 in FIG. 5.
Figure 8:
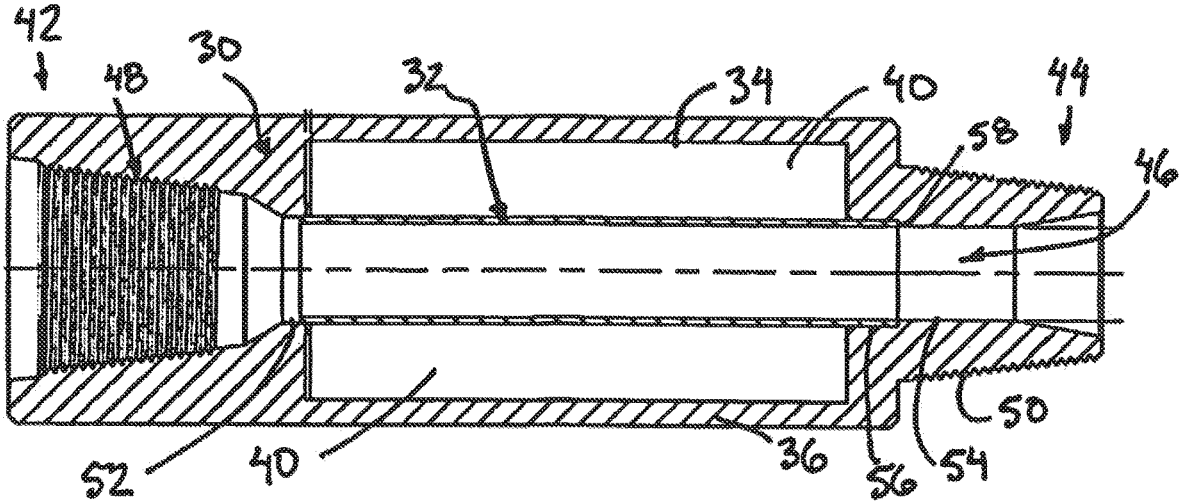
FIG. 8 is a sectional view of the wellbore magnetic tool apparatus along the line 8-8 in FIG. 7.
Figure 9:
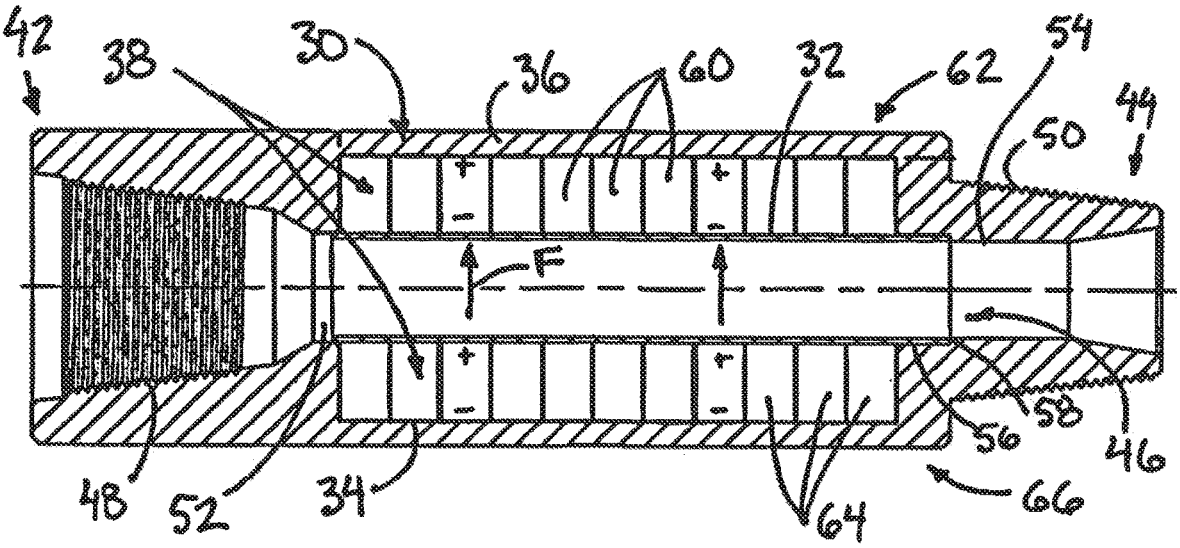
FIG. 9 is a sectional view of the wellbore magnetic tool apparatus along the line 9-9 in FIG. 5.

Furthermore, locating the cavities to be open to the interior of the tubular body while leaving the outer wall of the tubular body intact allows the cavity to be maximized in size which in turn maximizes the density of the magnetic material that can be carried by the tubular body. A comparison between the volume of magnetic elements that can be placed within the apparatus 10 according to the present invention and a prior art design according to FIGS. 2 and 3 is provided in the following.

Original Design:

| | |
|---|---|
| Number of holes/magnets | $N_o := 20$ |
| Diameter of magnets | $D_o := 1$ in |
| Length of magnets | $L_o := 1$ in |

-continued

| | |
|---|---|
| Volume of each magnet | $V_{mo} := \pi \cdot \frac{D_o^2}{4} \cdot L_o$ |
| | $V_{mo} = 0.785\ \text{in}^3$ |
| Total volume of magnets | $V_{to} := V_{mo} \cdot N_o$ |
| | $V_{to} = 15.708\ \text{in}^3$ |

New Design:

| | |
|---|---|
| Number of magnets | $N := 11 \cdot 2 \cdot 2 = 44$ |
| Outer diameter of magnets | $OD := 5.45\ \text{in}$ |
| Inner diameter of magnets | $ID := 2.25\ \text{in}$ |
| Thickness of magnets | $t := 1\ \text{in}$ |
| Arc angle of magnets | $\theta := 30\ deg$ |
| Volume of each magnet | $V_m := \pi \cdot \frac{\theta}{360\ deg}\left(\frac{OD^2}{4} - \frac{ID^2}{4}\right) \cdot t$ |
| | $V_m = 1.613\ \text{in}^3$ |
| Total volume of magnets | $V_t := V_m \cdot N$ |
| | $V_t = 70.958\ \text{in}^3$ |

Comparison:

| | |
|---|---|
| Volume Ratio | $\frac{V_t}{V_{to}} = 4.517$ |
| Improvement | $\sqrt[3]{\frac{V_t}{V_{to}}} = 1.653$ |

In further embodiments, the increased density of the cavity configuration of the present invention can be taken advantage of by making the overall tool shorter in length, while maintaining the same strength of magnetic field produced as compared to prior art arrangements.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A wellbore magnetic tool apparatus for generating a magnetic field emanating from a tubing string having a tubing passage extending longitudinally through the tubing string, the wellbore tool apparatus comprising:

a tubular body including a longitudinal passage extending axially through the tubular body between opposing ends of the tubular body;

tubing connectors mounted on the opposing ends of the tubular body respectively so as to be arranged to connect the tubular body in series with the tubing string such that the longitudinal passage of the tubular body communicates with the tubing passage of the tubing string;

a plurality of magnetic elements, each magnetic element having a magnetic field extending in a field direction from a first pole at a first end to a second pole at a second end of the magnetic element;

one or more cavities formed in the tubular body to as to be arranged to receive the magnetic elements therein such that the field directions of all magnetic elements are substantially aligned in a common direction extending along a diametrical axis of the tubular body;

said one or more cavities being open inwardly towards the longitudinal passage within the tubular body so as to be arranged to receive the magnetic elements inserted therein through the longitudinal passage in the tubular body; and one or more covers arranged to close said one or more cavities relative to the longitudinal passage in the tubular body with the plurality of magnetic elements enclosed within said one or more cavities;

wherein said one or more covers comprises an inner sleeve defining a portion of a length of the longitudinal passage through the tubular body.

2. The apparatus according to claim 1 wherein said one or more covers form part of a boundary wall surrounding the longitudinal passage extending through the tubular body.

3. The apparatus according to claim 1 wherein said one or more cavities is annular in shape about the inner sleeve.

4. The apparatus according to claim 1 wherein the inner sleeve is arranged to be inserted and removed axially through a first end among the opposing ends of the tubular body.

5. The apparatus according to claim 1 wherein an inner diameter of the inner sleeve is substantially identical to an inner diameter of a portion of the longitudinal passage that is defined by the tubular body.

6. The apparatus according to claim 1 wherein said said one of more covers are formed of non-ferromagnetic material.

7. The apparatus according to claim 1 wherein some of the magnetic elements are abutted with one another in a circumferential direction of the tubular body.

8. The apparatus according to claim 1 wherein some of the magnetic elements are abutted with one another in an axial direction of the tubular body.

9. The apparatus according to claim 1 wherein said one or more cavities comprises a single annular shaped cavity receiving all of the magnetic elements therein.

10. The apparatus according to claim 1 wherein the tubular body is formed of non-ferromagnetic material.

11. The apparatus according to claim 1 in combination with the tubing string, wherein the tubing string comprises a drill string including a drill motor and a drill bit supported at a bottom end of the drill string, the tubular body of the wellbore magnetic tool apparatus being mounted in series between the drill motor and the drill bit of the drill string.

12. A wellbore magnetic tool apparatus for generating a magnetic field emanating from a tubing string having a tubing passage extending longitudinally through the tubing string, the wellbore tool apparatus comprising:

a tubular body including a longitudinal passage extending axially through the tubular body between opposing ends of the tubular body:

tubing connectors mounted on the opposing ends of the tubular body respectively so as to be arranged to connect the tubular body in series with the tubing string such that the longitudinal passage of the tubular body communicates with the tubing passage of the tubing string;

a plurality of magnetic elements, each magnetic element having a magnetic field extending in a field direction from a first pole at a first end to a second pole at a second end of the magnetic element;

one or more cavities formed in the tubular body to as to be arranged to receive the magnetic elements therein such that the field directions of all magnetic elements are substantially aligned in a common direction extending along a diametrical axis of the tubular body;

said one or more cavities being open inwardly towards the longitudinal passage within the tubular body so as to be arranged to receive the magnetic elements inserted therein through the longitudinal passage in the tubular body; and one or more covers arranged to close said one or more cavities relative to the longitudinal passage in the tubular body with the plurality of magnetic elements enclosed within said one or more cavities;

wherein said one or more covers are mounted within the tubular body in an interference fit relationship.

13. A wellbore magnetic tool apparatus for generating a magnetic field emanating from a tubing string having a tubing passage extending longitudinally through the tubing string, the wellbore tool apparatus comprising:

a tubular body including a longitudinal passage extending axially through the tubular body between opposing ends of the tubular body:

tubing connectors mounted on the opposing ends of the tubular body respectively so as to be arranged to connect the tubular body in series with the tubing string such that the longitudinal passage of the tubular body communicates with the tubing passage of the tubing string;

a plurality of magnetic elements, each magnetic element having a magnetic field extending in a field direction from a first pole at a first end to a second pole at a second end of the magnetic element;

one or more cavities formed in the tubular body to as to be arranged to receive the magnetic elements therein such that the field directions of all magnetic elements are substantially aligned in a common direction extending along a diametrical axis of the tubular body;

said one or more cavities being open inwardly towards the longitudinal passage within the tubular body so as to be arranged to receive the magnetic elements inserted therein through the longitudinal passage in the tubular body; and one or more covers arranged to close said one or more cavities relative to the longitudinal passage in the tubular body with the plurality of magnetic elements enclosed within said one or more cavities;

wherein a material forming said one or more covers is identical to a material forming the tubular body.

14. A wellbore magnetic tool apparatus for generating a magnetic field emanating from a tubing string having a tubing passage extending longitudinally through the tubing string, the wellbore tool apparatus comprising:

a tubular body including a longitudinal passage extending axially through the tubular body between opposing ends of the tubular body;

tubing connectors mounted on the opposing ends of the tubular body respectively so as to be arranged to connect the tubular body in series with the tubing string such that the longitudinal passage of the tubular body communicates with the tubing passage of the tubing string;

a plurality of magnetic elements, each magnetic element having a magnetic field extending in a field direction from a first pole at a first end to a second pole at a second end of the magnetic element;

one or more cavities formed in the tubular body to as to be arranged to receive the magnetic elements therein such that the field directions of all magnetic elements are substantially aligned in a common direction extending along a diametrical axis of the tubular body;

said one or more cavities being open inwardly towards the longitudinal passage within the tubular body so as to be arranged to receive the magnetic elements inserted therein through the longitudinal passage in the tubular body; and one or more covers arranged to close said one or more cavities relative to the longitudinal passage in the tubular body with the plurality of magnetic elements enclosed within said one or more cavities;

wherein each magnetic element is wedge shaped so as to increase in dimension in a circumferential direction with increasing radial distance from the longitudinal passage.

15. The apparatus according to claim 14 wherein the magnetic elements include first magnetic elements supported at a first side of the tubular body and second magnetic elements supported at a second side of the tubular body opposite to the first side along said diametrical axis, wherein the first magnetic elements increase in width in the field direction from the first pole to the second pole, and wherein the second magnetic elements decrease in width in the field direction from the first pole to the second pole.

16. A wellbore magnetic tool apparatus for generating a magnetic field emanating from a tubing string having a tubing passage extending longitudinally through the tubing string, the wellbore tool apparatus comprising:

a tubular body including a longitudinal passage extending axially through the tubular body between opposing ends of the tubular body;

tubing connectors mounted on the opposing ends of the tubular body respectively so as to be arranged to connect the tubular body in series with the tubing string such that the longitudinal passage of the tubular body communicates with the tubing passage of the tubing string;

a plurality of magnetic elements, each magnetic element having a magnetic field extending in a field direction from a first pole at a first end to a second pole at a second end of the magnetic element;

one or more cavities formed in the tubular body to as to be arranged to receive the magnetic elements therein such that the field directions of all magnetic elements are substantially aligned in a common direction extending along a diametrical axis of the tubular body;

said one or more cavities being open inwardly towards the longitudinal passage within the tubular body so as to be arranged to receive the magnetic elements inserted therein through the longitudinal passage in the tubular body;

one or more covers arranged to close said one or more cavities relative to the longitudinal passage in the tubular body with the plurality of magnetic elements enclosed within said one or more cavities;

said one or more cavities being annular in shape about the longitudinal passage;

the magnetic elements including first magnetic elements supported at a first side of the tubular body and second magnetic elements supported at a second side of tubular body opposite to the first side along said diametrical axis; and one or more spacers supported in said one or more cavities between the first magnetic elements and the second magnetic elements.

17. The apparatus according to claim 16 wherein the magnetic elements and the one or more spacers collectively fully occupy said one or more cavities.

* * * * *